US006079371A

United States Patent [19]

Moroi et al.

[11] Patent Number: 6,079,371

[45] Date of Patent: Jun. 27, 2000

[54] VISCOUS FLUID HEATER

[75] Inventors: Takahiro Moroi; Takashi Ban; Nobuaki Hoshino; Takanori Okabe, all of Kariya, Japan

[73] Assignee: Kabushiki Kaisha Toyoda Jidoshokki Seisakusho, Aichi-Ken, Japan

[21] Appl. No.: 09/063,576

[22] Filed: Apr. 21, 1998

[30] Foreign Application Priority Data

Apr. 24, 1997 [JP] Japan ..... 9-107543

[51] Int. Cl.[7] ..... F22B 3/06

[52] U.S. Cl. ..... 122/26; 126/247

[58] Field of Search ..... 122/26, 247; 237/12.3 R, 237/12.3 B

[56] References Cited

U.S. PATENT DOCUMENTS

| | | | |
|---|---|---|---|
| 4,424,797 | 1/1984 | Perkins | 126/247 |
| 4,501,231 | 2/1985 | Perkins | 122/26 |
| 4,993,377 | 2/1991 | Itakura | 123/142 |
| 5,573,184 | 11/1996 | Martin . | |
| 5,765,545 | 6/1998 | Ban et al. | 126/247 |
| 5,842,635 | 12/1998 | Okabe et al. | 122/26 |

FOREIGN PATENT DOCUMENTS

| | | |
|---|---|---|
| 2-246823 | 10/1990 | Japan . |
| 2254010 | 10/1990 | Japan . |

*Primary Examiner*—Denise L. Ferensic
*Assistant Examiner*—Jiping Lu
*Attorney, Agent, or Firm*—Morgan & Finnegan, L.L.P.

[57] ABSTRACT

An improved viscous fluid type heater is disclosed. The heater has a heating chamber and a heat exchange chamber. The heating chamber accommodates viscous fluid and a rotor that rotates and shears the viscous fluid to produce heat. The heat exchange chamber allows circulating fluid to flow therethrough, whereby the heat is transmitted to the heat exchange chamber from the heating chamber to heat the circulating fluid. A reservoir chamber communicates with the heating chamber for an auxiliary reservoir of the viscous fluid. A stirring member is provided in the reservoir chamber and stirs the viscous fluid in the reservoir chamber.

10 Claims, 4 Drawing Sheets

VISCOUS FLUID HEATER

BACKGROUND OF THE INVENTION

The present invention relates to a viscous heater that genarates heat by shearing viscous fluid by rotor rotation in a heating chamber and transfers the heat to coolant circulating through a heat exchange chamber.

Automotive vehicles are generally equipped with hot water type heaters. A vehicle equipped with such a heater uses coolant to cool its engine. The coolant is supplied to a heater core and then heats the air in the passenger compartment.

It is difficult to maintain the coolant temperature above a certain level, for example 80° C., in diesel engines and lean-burn engines, which generate less heat. In these cases, the hot water type heater does not supply enough heat for warming the passenger compartment.

To solve this problem, it has been proposed to provide a viscous fluid heater to heat the coolant. The viscous fluid heater has a heating chamber and a water jacket (heat exchange chamber), partitioned within a housing. The heater also has a drive shaft and a rotor driven by the engine. Viscous fluid, such as high viscosity silicone oil, is accommodated in the heating chamber and sheared by the rotor. The rotor generates heat by shearing the viscous fluid, and the resulting heat increases the temperature of the coolant circulating through the water jacket.

The temperature of the viscous fluid enclosed in the heating chamber increases as the engine speed increases without regard to the coolant temperature. Silicone oil is often used as the viscous fluid. Silicone oil is liable to deteriorate because of the heat and shearing when its temperature goes beyond, for example, 250° C. When such deterioration occurs, the efficiency of heat generation by shearing viscous fluid goes down, and this degrades the heating capacity in the passenger compartment. Thus, it is necessary to take measures to prevent and deter the viscous fluid deterioration.

SUMMARY OF THE INVENTION

Accordingly, it is an objective of the present invention to provide a viscous fluid heater that accommodates more viscous fluid and avoids excessive heating of the viscous fluid by using all of it evenly so that the viscous fluid heater will maintain its heating performance without deteriorating the viscous fluid.

To achieve the above objective, an improved viscous fluid type heater is disclosed. The heater has a heating chamber and a heat exchange chamber. The heating chamber accommodates viscous fluid and a rotor that rotates and shears the viscous fluid to produce heat. The heat exchange chamber allows circulating fluid to flow therethrough, whereby the heat is transmitted to the heat exchange chamber from the heating chamber to heat the circulating fluid. A reservoir chamber communicates with the heating chamber for an auxiliary reservoir of the viscous fluid. A stirring member is provided in the reservoir chamber and stirs the viscous fluid in the reservoir chamber.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawing in which:

DETAILED DESCRIPTION OF THE PREFERRED EMBODIMENTS

Figure 1:
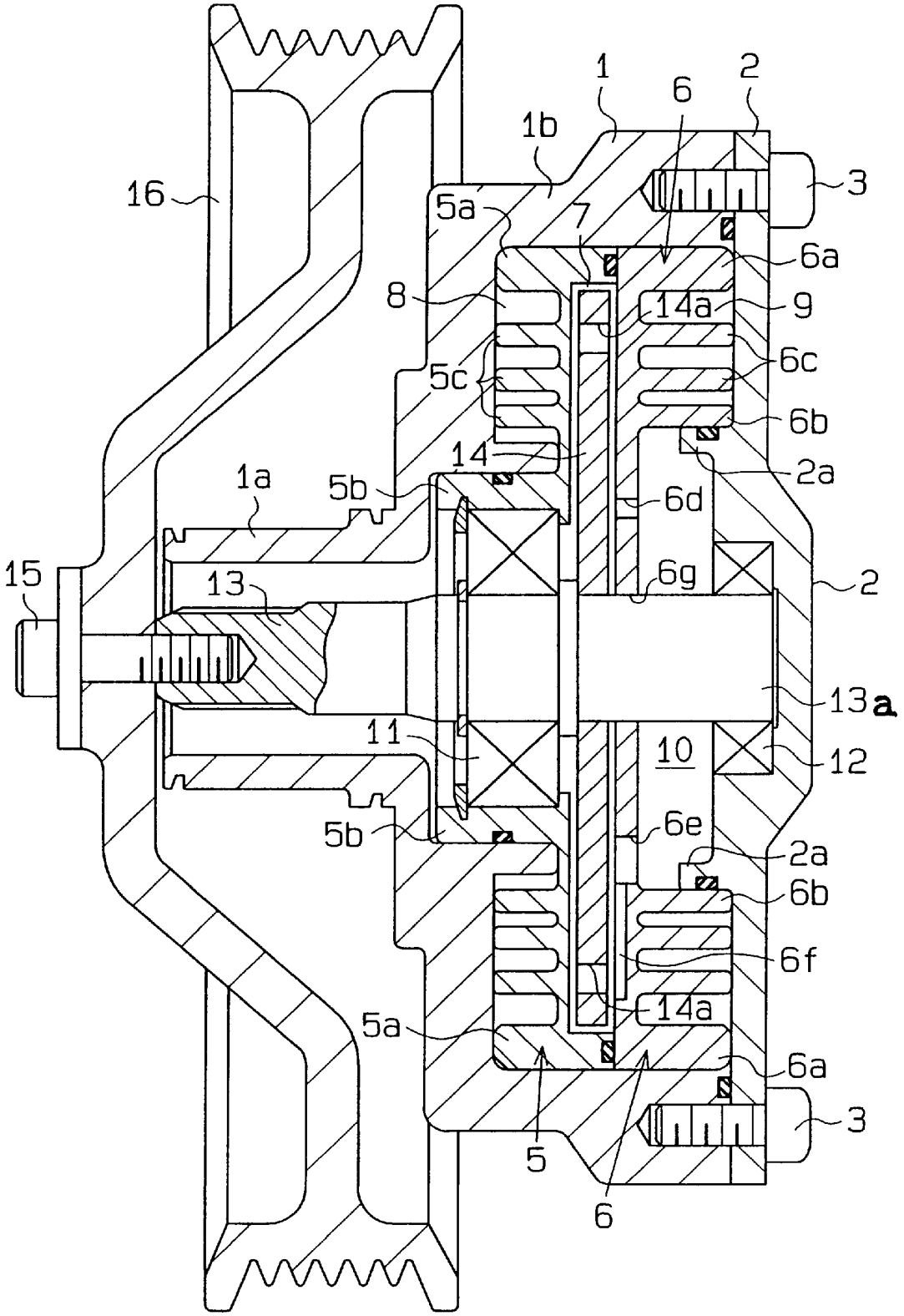
FIG. 1 is a longitudinal sectional view of a viscous fluid heater in accordance with the present invention.

One embodiment of a viscous fluid heater according to the present invention will now be described referring to FIG. 1. As shown in FIG. 1, the viscous fluid heater has a housing including a front body 1 and a rear body 2. The front body 1 includes a hollow cylindrical boss 1*a* extending to the front (left side in FIG. 1) and a case 1*b* extending like a bowl from the proximal portion of the boss 1*b*. The rear body 2 is shaped like a lid to cover the opening of the case 1*b*. The front body 1 and the rear body 2 are fastened to each other by bolts 3 with a pair of partition plates 5, 6 arranged inside its case 1*b*.

The partition plates 5, 6 have corresponding annular rims 5*a*, 6*a* around their peripherals. The rims 5*a* and 6*a* are clamped together between the front body 1 and the rear body 2 to fix the partition plates 5 and 6. The rear side of the partition plate 5 is recessed and forms a heating chamber 7.

As explained above, the housing of the viscous fluid heater includes the front body 1, the rear body 2 and the partition plates 5, 6. These housing members are made of aluminum or aluminum alloy.

The partition plate 5 has on its front side a support hub 5*b* projecting from its central portion and guide fins 5*c* extending concentrically around the support hub 5*b*. The partition plate 5 is fitted inside the front body 1 in a manner to fit the support hub 5*b* to the inner wall of the front body 1. As a result, a front annular water jacket 8, which serves as a heat exchange chamber, is defined between the inner walls of the front body 1 and the partition plate 5. The rims 5*a*, the support hub 5*b* and the guide fins 5*c* serve as guide walls to guide the flow of coolant in the water jacket 8.

The rear partition plate 6 has on its rear end (right side in FIG. 1) a hub 6*b* extending from its central portion and guide fins 6*c* extending concentrically around the hub 6*b*. The partition plate 6 is fitted inside the front body 1 with the other plate 5 so that the hub 6*b* engages with an annular wall 2*a* of the rear body 2. As a result, a rear annular water jacket 9 and a oil storage chamber 10 are defined between the rear body 2 and the partition plate 6. The water jacket 9 serves as a heat exchange chamber adjacent to the rear side of the heating chamber 7. The oil storage chamber 10 serves as a reservoir chamber located in the hub 6*b*. The rims 6*a*, the hub 6*b*, and the guide fins 6*c* serve as guide walls to guide the flow of coolant in the rear heat exchange chamber.

The front body 1 has a side wall provided with an inlet port (not shown) and an outlet port (not shown) for the coolant. The coolant comes from a vehicle heating system (not shown) and enters the water jackets 8, 9 through the inlet port. Then, the coolant is sent back to the heating system through the outlet port.

As shown in FIG. 1, a drive shaft 13 is rotatably supported by a front bearing 11, which is fitted on the plate 5, and a rear bearing 12, which is fitted on the rear body 2. As a result, the rear end 13*a* of the drive shaft 13 is located in the oil storage chamber 10. The bearing 11, which is between the inner wall of the support hub 5*b* and the drive shaft 13, has a seal that seals the front of the heating chamber 7. The surface of the drive shaft 13 and the inner wall of a bore 6*g* are spaced apart by a slight clearance to enable the rotation of the drive shaft 13.

A disk-like rotor 14 is fitted on the drive shaft 13 so that the rotor 14 will rotate integrally with the drive shaft 13. The rotor is located in the heating chamber 7. The rotor has rotor bores 14*a* located near its peripheral edge. The rotor bores 14*a* are arranged at equal distances from the axis of the drive shaft 13 and at equal angular intervals.

The oil storage chamber 10, which serves as a 152 reservoir, is surrounded by the hub 6*b* of the partition plate 6 and the rear wall of the rear body 2. Upper and lower communication bores 6*d*, 6*e* extend axially through the partition plate 6. A guide groove 6*f* extends radially along the partition plate 6. The upper communication bore 6*d* serves as a return passage, while the lower communication bore serves as a supply passage. The heating chamber 7 and the oil storage chamber 10 communicate with each other through the upper and lower communication bores 6*d*, 6*e*. The opening area of the lower communication bore 6*e* is larger than that of the upper communication bore 6*d*.

The heating chamber 7 and the oil storage chamber 10 define a sealed space that prevents the leakage of fluid. A certain amount of silicone oil, which serves as a viscous fluid, is charged into the sealed space. The silicone oil is charged until it occupies 50 to 80 percent of the sealed space volume under a status of non-operating and normal temperatures. When the rotor 14 is rotated, some silicone oil is supplied to the heating chamber 7 from the oil storage chamber 10 through the lower communication bore 6*e* and the guide groove 6*f*. At the same time, some heated silicone oil is returned from the heating chamber 7 and sent to the oil storage chamber 10 through the upper communication bore 6*d*. Therefore the silicone oil is circulated between the heating chamber 7 and the oil storage chamber 10. When the silicone oil is being circulated, the upper communication bore 6*d* is located above the surface level of silicone oil in the oil storage chamber 10 and the lower communication bore 6*e* is located below the surface level.

A pulley 16 is fixed on the front end of the drive shaft 13 by a bolt 15. The pulley 16 is rotated by the vehicle engine (not shown) by means of a V belt connecting the pulley 16 and the external drive source (engine).

The operation of the viscous fluid heater will now be described. Before the engine starts, that is, when the drive shaft 13 is stopped, the surface levels of silicone oil (viscous fluid) are the same in the heating chamber 7 and the oil storage chamber 10. Consequently, the contact area between the rotor 14 and the viscous fluid is relatively small when the drive shaft starts rotating. This means that only a small torque is necessary to start the rotation of the pulley 16, the drive shaft 13 and the rotor 14. When the rotor 14 is driven integrally with the drive shaft 13 by the engine, the silicone oil is sheared between the inner walls of the heating chamber 7 and the surfaces of the rotor 14. This generates heat in the heating chamber 7. The heat is transferred to the coolant flowing through the water jackets 8, 9 by way of the partition plates 5, 6. The heated coolant is used for heating the passenger compartment through the heating system (not shown).

The heating chamber 7 is connected to the oil storage chamber 10 through the upper communication bore 6*d*, and the silicone oil in the heating chamber 7 moves toward the drive shaft 13 when the rotor 14 rotates. This is known as the Weissenberg effect. This effect helps return the silicone oil from the heating chamber 7 to the oil storage chamber 10 through the communication bore 6*d*.

The returned silicone oil stays in the oil storage chamber 10 for a certain time according to the circulation cycle time. When in the chamber, the silicone oil touching the partition member (partition plate 6) tends to cool easily as its heat is transferred to the coolant through the partition member. On the other hand, when the silicone oil has been returned from the heating chamber 7, it has a higher temperature, though it cools down gradually since it is no longer being sheared. The high temperature oil has a relatively low viscosity, but the cooled oil has relatively high viscosity, and this inhibits mixing of the fluid. Furthermore, this causes a temperature difference between different regions of the oil storage chamber 10.

However, the rear end 13*a* of the drive shaft 13, which occupies the oil storage chamber 10, stirs the oil in the oil storage chamber 10. All the silicone oil in the oil storage chamber 10 is stirred evenly because the oil is drawn towards the rotation of the drive shaft 13 due to the Weissenberg effect. Therefore, the high temperature, low viscosity oil and the low temperature, high viscosity oil are mixed evenly, and this causes the temperature and viscosity of the oil in the oil storage chamber 10 to be uniform. Then, the silicone oil in the oil storage chamber 10 is drawn to the heating chamber 7 through the lower communication bore 6*e* by its weight and the drawing action between the oil and the rotor 14.

As explained above, the silicone oil is circulated between the heating chamber 7 and the oil storage chamber 10 when the drive shaft 13 and the rotor 14 are driven. In this case, the supply amount of silicone oil to the heating chamber 7 is larger than the return amount in the oil storage chamber 10, because the opening area of the lower communication bore 6*e* is larger than that of the upper a communication bore 6*d*. Accordingly, the silicone oil that had been reserved in the oil storage chamber 10 is supplied to the peripheral region of the heating chamber 7 promptly and smoothly through the guide groove 6*f*. The silicone oil supplied to the peripheral region is drawn to the middle region of the heating chamber 7 by the Weissenberg effect, and this causes the silicone oil to fill the clearance between the inner walls of the heating chamber 7 and the surfaces of the rotor 14.

The viscous fluid heater according to the present embodiment has the following advantages.

The drive shaft 13, the rear end of which is located in the oil storage chamber 10, stirs the silicone oil in the oil storage chamber 10. Because of this, the high temperature silicone oil, which was most recently returned from the heating chamber 7, and the relatively low temperature silicone oil already in the oil storage chamber 10 are stirred to unify the temperature of the silicone oil. Accordingly, deterioration of the silicone oil due to lengthy heat exposure is avoided by resting and cooling the oil for a certain time.

The viscosity of silicone oil is made uniform by stirring the silicone oil in the oil storage chamber 10. Because of this, the silicone oil is circulated between the heating chamber 7 and the oil storage chamber 10 smoothly and evenly. Accordingly, thermal deterioration of silicone oil caused by continuously shearing the same oil is avoided. The smooth and even circulation of silicone oil also improves the efficiency of heat transfer to the coolant through the partition member (partition plate 6) in the oil storage chamber 10.

The front bearing 11 is arranged on the middle region of the drive shaft 13 and the rear bearing 12 on the rear end. The drive shaft 13 is supported at the two supporting points of the bearings 11 and 12. Because of this, the drive shaft 13 and the rotor 14 do not incline when an external load (for example, tension of the V belt on the pulley 16) is applied to them, and their stable rotation is assured. The constant space between the surface of the rotor 14 and the inner walls of heating chamber 7 is also maintained. Accordingly, the clearance between the surfaces of the rotor 14 and the inner walls of the heating chamber 7 is minimized, and this improves the heating capacity of the viscous fluid heater without changing its size.

The apparatus described above may be varied as follows.

In the embodiment shown in FIG. 1, the drive shaft 13 itself functions as a stirrer. However, other additional stirring means may be used to promote the stirring action, some of which are described below.

Figure 2:
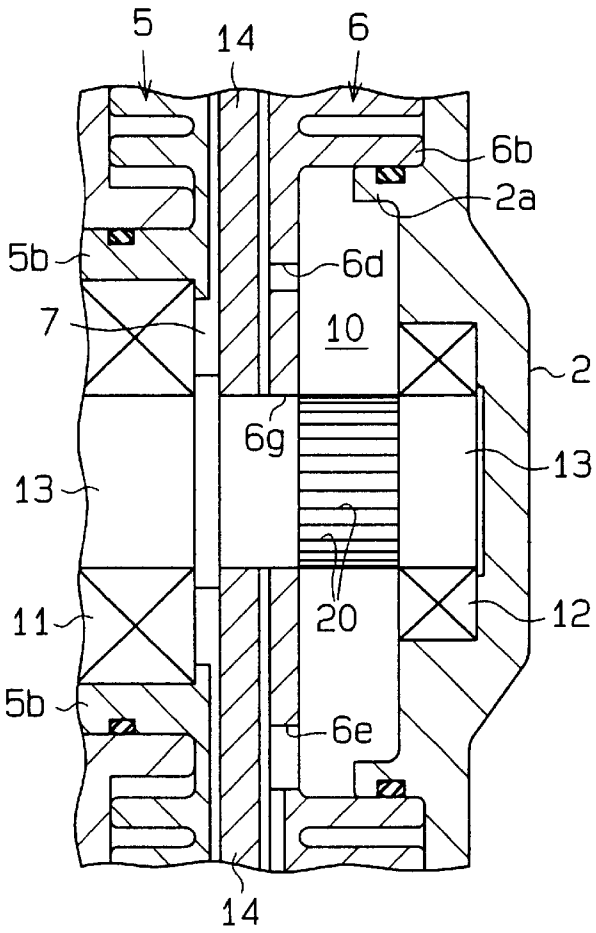
FIG. 2 is a partial enlarged sectional view of a viscous fluid heater according to a further embodiment.

The portion of the drive shaft 13 located in the oil storage chamber 10 may be modified. For example, as shown in FIG. 2, axial grooves 20 may be formed axially on the surface of the drive shaft 13. This enhances the stirring efficiency and quickly makes the temperature and viscosity of the silicone oil uniform.

Figure 3:
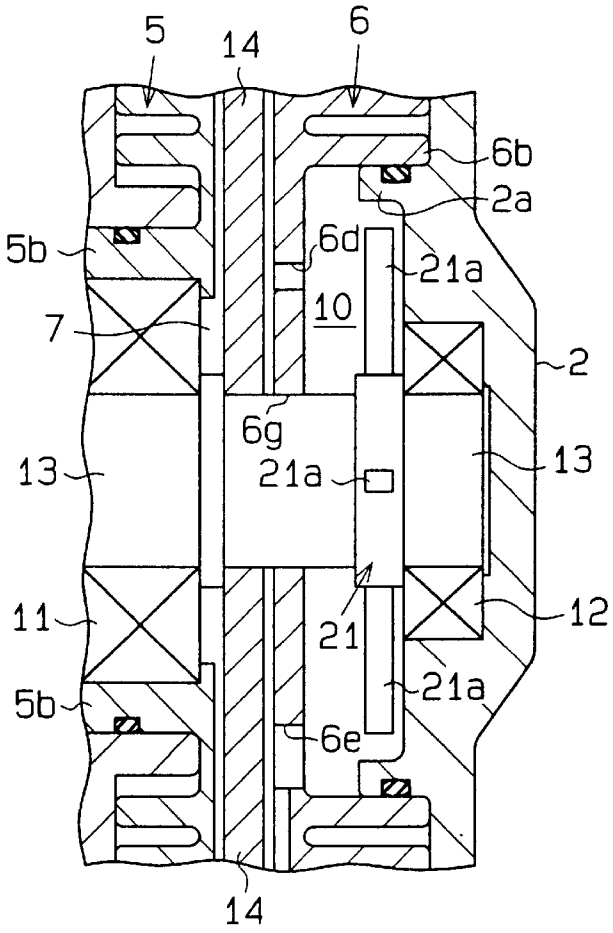
FIG. 3 is a partial enlarged sectional view of a viscous fluid heater according to a further embodiment.

A member may be attached to the portion of the drive shaft 13 positioned in the oil storage chamber 10. For example, as shown in FIG. 3, an impeller 21 may be attached to the drive shaft 13. The impeller 21 has four blades 21*a* arranged at angular intervals of 90 degrees. The distal end of each blade 21*a* reaches the vicinity of the annular wall 2*a* of the rear body 2. The impeller 21 rotates integrally with the drive shaft 13 and positively stirs the silicone oil in the oil storage chamber 10.

Figure 4:
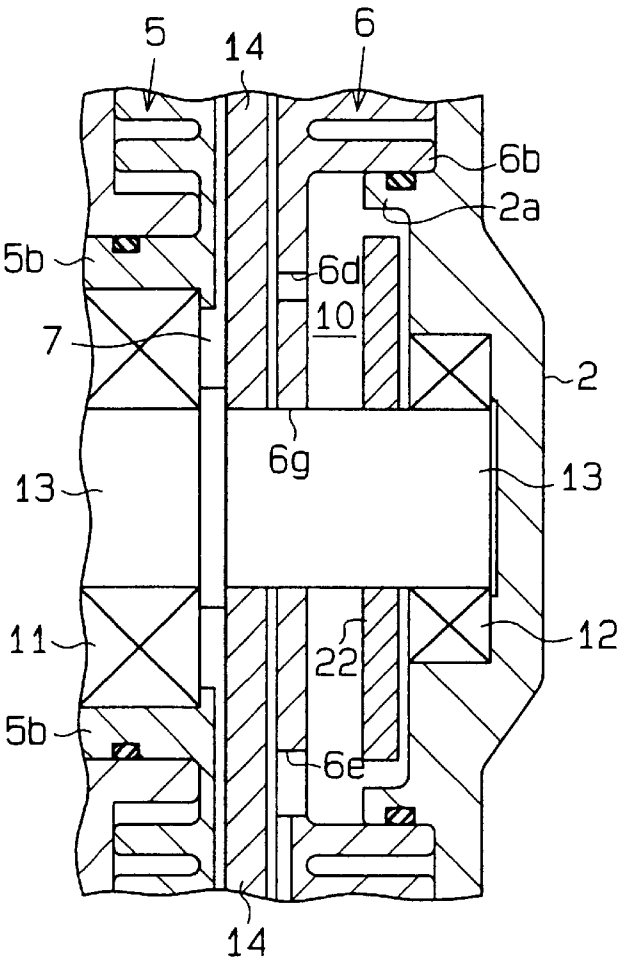
FIG. 4 is a partial enlarged sectional view of a viscous fluid heater according to a further embodiment.

A small rotor 22 as shown in FIG. 4 may be attached to the drive shaft 13. The peripheral edge of the small rotor 22 reaches the vicinity of the annular wall 2*a* of the rear body 2. The small rotor 22 rotates integrally with the drive shaft 13. The rotation generates either a Weissenberg effect or centrifugal force according to the rotation speed, and the silicone oil moves radially with respect to the small rotor 22. The oil movement causes convection current of the oil in the reservoir chamber (oil storage chamber 10). Consequently, the oil in the oil storage chamber 10 is stirred efficiently by the small rotor 22.

The impeller 21 and the small rotor 22 produce the same result as the axial grooves 20. The stirring members are preferably positioned in the rear region of the oil storage chamber 10, which needs stirring most considering the distribution of temperature and viscosity in the oil storage chamber 10.

These variations give the highest priority to positively stirring the silicone oil in the oil storage chamber 10. However, the stirring action also causes fluid friction and generates heat as a result. Especially when the small rotor 22 is employed and positioned close to the inner wall of the rear body 2, heat generation occurs. In this case, better heat transfer to the coolant is performed as a secondary effect of the efficient stirring action.

Figure 5:
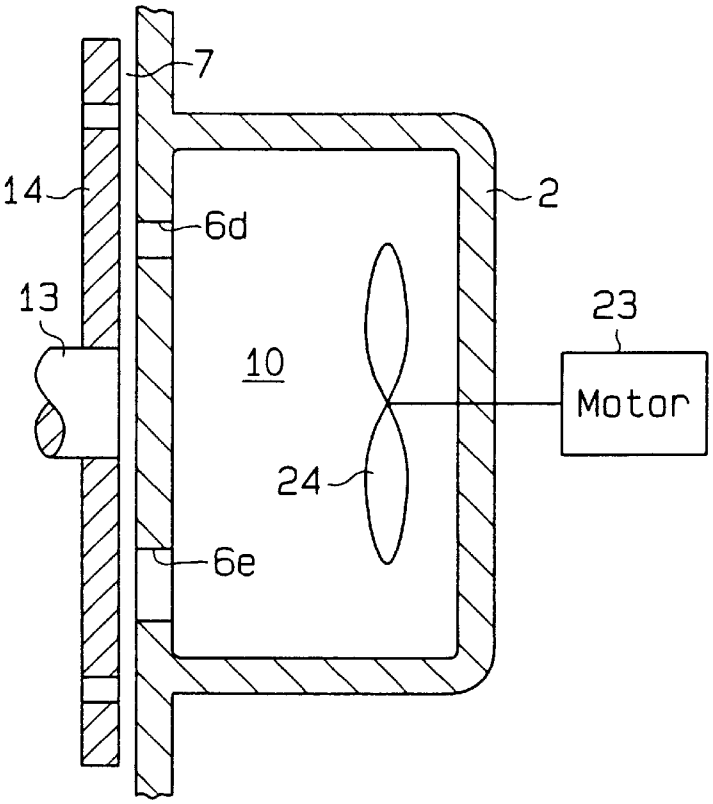
FIG. 5 is a schematic sectional view of a viscous fluid heater according to a further embodiment.

The stirring shaft surface in the embodiment shown in FIG. 1 and the variations shown in FIG. 2 to FIG. 4 use the engine as their drive source. However, another drive source may be provided to drive a stirrer in the oil storage chamber 10. For example, as shown in FIG. 5, a motor 23 may be provided as a drive source. A propeller 24 may be fixed to the axis of the motor 23 as a stirrer. The stirrer shown in FIG. 5 produces an effect similar to the other means shown in FIG. 1 to FIG. 4.

Figure 6:
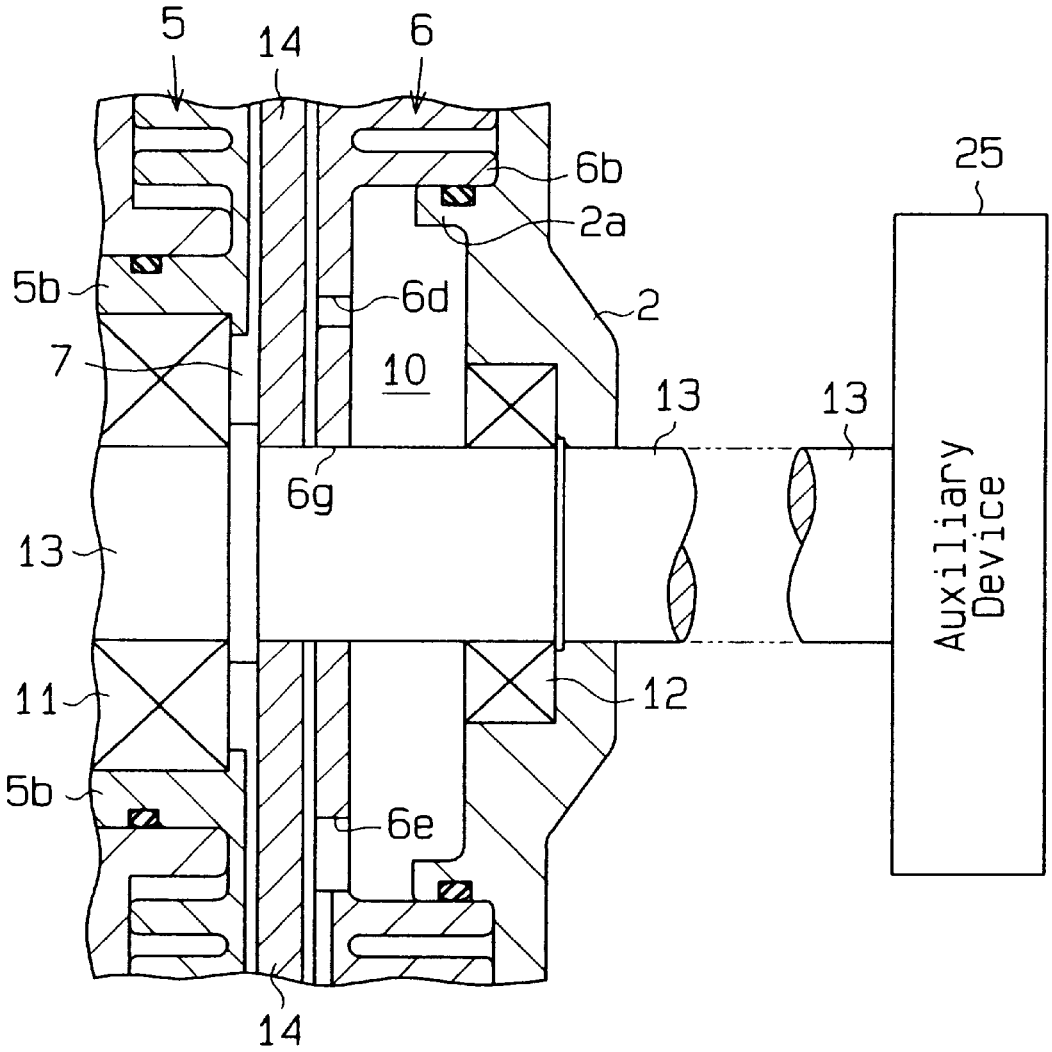
FIG. 6 is a partial enlarged sectional view of a viscous fluid heater according to a further embodiment.

Driving force from the engine is transmitted to the drive shaft 13 and the rotor 14 and is used to shear the silicone oil in the heating chamber 7 and to stir the silicone oil in the oil storage chamber 10. However, the driving force may also be used to drive other devices such as an auxiliary device 25. As shown in FIG. 6, the drive shaft 13 passes through the rear body 2 and is connected to the auxiliary device 25, which may be a water pump. The rear bearing 12 has a seal that seals the rear portion of the rear body 2. Consequently, the driving force of the engine is used for other purposes in addition to producing the effect obtained in the embodiment of FIG. 1.

An electromagnetic clutch mechanism may also be employed between the pulley 16 and the drive shaft 13 in each viscous fluid heater shown in FIG. 1 to FIG. 6 to selectively transmit the driving force from the engine to the drive shaft 13. In this case, the transmission of driving force is started and stopped according to necessity and the shearing of silicone oil in the heating chamber 10 is suppressed. This deters silicone oil deterioration caused by excessive shearing and heating.

In the embodiment shown in FIG. 1, the surface of the drive shaft 13 and the wall of bore 6*g* of the rear partition plate 6 are separated with little clearance between each 20, other. However, an oil seal may be used to seal the clearance. This prevents the silicone oil from moving through the bore 6*g*.

The term "viscous fluid" referred to in this specification means any kind of medium that generates heat based on fluid friction caused by shearing action of rotor rotation. Accordingly, the term is not limited to mean high-viscosity fluid and semi-fluid, much less silicone oil.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A viscous fluid type heater comprising a heating chamber, a rotatable rotor within the heating chamber, and a heat exchange chamber, the heat exchange chamber being located adjacent to the heating chamber, said heating chamber for accommodating viscous fluid and said rotor for shearing the viscous fluid to produce heat, said heat exchange chamber allowing circulating fluid to flow therethrough, wherein the heat is transmitted to the heat exchange chamber from the heating chamber to heat the circulating fluid, said heater further comprising:

a reservoir chamber communicating with the heating chamber for providing an auxiliary reservoir for the viscous fluid;

a partition plate for defining in part the heating chamber and the reservoir chamber, the partition plate having a through hole for communicating the heating chamber with the reservoir chamber, wherein the partition plate is independent of the rotor and faces the rotor;

stirring means for stirring the viscous fluid in the reservoir chamber; and a drive shaft carrying the rotor thereon, said drive shaft having a portion extending through said partition plate and into the reservoir chamber to provide at least a part of the stirring means for stirring the viscous fluid in the reservoir chamber.

2. The heater as set forth in claim 1, further comprising facilitating means provided on the portion of the drive shaft for facilitating stirring of the viscous fluid in the reservoir chamber.

3. The heater as set forth in claim 3, wherein said facilitating means includes an impeller provided on the portion of the drive shaft.

4. The heater as set forth in claim 2, wherein said facilitating means includes a second rotor mounted on the portion of the drive shaft within the reservoir chamber.

5. The heater as set forth in claim 1, wherein said viscous fluid includes silicone oil.

6. A viscous fluid type heater including a heating chamber and a heat exchange chamber, wherein said heating chamber accommodates viscous fluid and a rotor that rotates and shears the viscous fluid to produce heat, wherein said heat exchange chamber allows circulating fluid to flow therethrough, wherein the heat is transmitted to the heat exchange chamber from the heating chamber to heat the circulating fluid, said heater comprising:

a reservoir chamber communicating with the heating chamber for providing an auxiliary reservoir of the viscous fluid;

stirring means for stirring the viscous fluid in the reservoir chamber;

a drive shaft carrying the rotor thereon, said drive shaft having a portion extending into the reservoir chamber to form at least a part of the stirring means; and facilitating mean provided on the portion of the drive shaft for facilitating stirring of the viscous fluid in the reservoir chamber;

said facilitating means including a plurality of grooves provided on the portion of the drive shaft.

7. The heater as set forth in claim 6, wherein said plurality of grooves extend in an axial direction with respect to the drive shaft.

8. A viscous fluid type heater including a heating chamber and a heat exchange chamber, wherein said heating chamber accommodates viscous fluid and a rotor that rotates and shears the viscous fluid to produce heat, wherein said heat exchange chamber allows circulating fluid to flow therethrough, wherein the heat is transmitted to the heat exchange chamber from the heating chamber to heat the circulating fluid, said heater comprising:

a reservoir chamber communicating with the heating chamber for providing an auxiliary reservoir of the viscous fluid;

a partition plate partitioning the heating chamber and the reservoir chamber, said partitioning plate having an upper through hole and a lower through hole, wherein said lower through hole has an opening larger than that of the upper through hole; and stirring means for stirring the viscous fluid in the reservoir chamber.

9. The heater as set forth in claim 8, wherein said stirring means includes:

a propeller disposed in the reservoir chamber; and actuating means for actuating the propeller, said actuating means functioning separately from the drive shaft.

10. A viscous fluid type heater including a heating chamber and a beat exchange chamber, wherein said heating chamber accommodates viscous fluid and a rotor that rotates and shears the viscous fluid to produce heat, wherein said heat exchange chamber allows circulating fluid to flow therethrough, wherein the heat is transmitted to the heat exchange chamber from the heating chamber to heat the circulating fluid, said heater comprising:

a reservoir chamber communicating with the heating chamber for providing an auxiliary reservoir for the viscous fluid;

stirring means for stirring the viscous fluid in the reservoir chamber;

facilitating means for facilitating stirring of the viscous fluid in the reservoir chamber; and a drive shaft carrying the rotor thereon, said drive shaft having a portion extending into the reservoir chamber to form at least a part of the stirring means;

said facilitating means being provided on the portion of the drive shaft and said facilitating means including a plurality of grooves extending in an axial direction with respect to the drive shaft.

* * * * *

UNITED STATES PATENT AND TRADEMARK OFFICE

CERTIFICATE OF CORRECTION

PATENT NO. : 6,079,371
DATED : June 27, 2000
INVENTOR(S) : Takahiro Moroi et al.

It is certified that error appears in the above-identified patent and that said Letters Patent is hereby corrected as shown below:

Column 4,
Line 45, after "upper" delete "a";

Column 6,
Line 32, after "each" delete "20.";

Column 7,
Line 12, after "claim" change "3" to -- 2 --;

Column 8,
Line 24, after "a" change "beat" to -- heat --.

Signed and Sealed this

Second Day of October, 2001

*Attest:*

Nicholas P. Godici

NICHOLAS P. GODICI
*Acting Director of the United States Patent and Trademark Office*

*Attesting Officer*